US005584088A

United States Patent [19]

Pauldine

[11] Patent Number: 5,584,088

[45] Date of Patent: Dec. 17, 1996

[54] ROTATING HAIR BRUSH

[76] Inventor: Concetta J. Pauldine, 175 E. 5th St., Oswego, N.Y. 13126

[21] Appl. No.: 521,947

[22] Filed: Nov. 6, 1995

[51] Int. Cl.[6] ..... A46B 7/10

[52] U.S. Cl. ..... 15/27

[58] Field of Search ..... 15/27

[56] References Cited

U.S. PATENT DOCUMENTS

| | | | |
|---|---|---|---|
| 3,909,868 | 10/1975 | Nogues | 15/27 |
| 3,947,910 | 4/1976 | Akerman | 15/27 |
| 4,197,608 | 4/1980 | Holley et al. | 15/27 |
| 4,443,688 | 4/1984 | Andis | 15/27 |
| 4,656,684 | 4/1987 | Jewett | 15/27 |
| 4,685,165 | 8/1987 | Fronius | 15/27 |

FOREIGN PATENT DOCUMENTS

| | | | |
|---|---|---|---|
| 1222686 | 1/1960 | France | 15/27 |
| 270891 | 2/1914 | Germany | 15/27 |
| 2172201 | 9/1986 | United Kingdom | 15/27 |

*Primary Examiner*—Mark Spisich

[57] ABSTRACT

A rotating hair brush comprised of a handle portion having a detent projection formed on an end portion thereof and a slot formed in an opposing side therefrom. A rotating brush portion has a plurality of bristles extending radially therearound. The rotating brush portion has a shaft portion dimensioned to be rotatably received within the handle portion. A rotation lock portion has a shaft portion dimensioned to be received within the handle portion. The shaft portion has a first detent and a second detent formed therein. The first detent and the second detent selectively cooperate with the detent projection of the handle portion.

5 Claims, 3 Drawing Sheets

ROTATING HAIR BRUSH

BACKGROUND OF THE INVENTION

1. Field of the Invention

The present invention relates to a rotating hair brush and more particularly pertains to rotating a hair brush so as not to pull on hair while brushing with a rotating hair brush.

2. Description of the Prior Art

The use of cylindrical hair brushes is known in the prior art. More specifically, cylindrical hair brushes heretofore devised and utilized for the purpose of styling and grooming hair are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,656,684 to Jewett discloses a tangle-free blow-dry brush.

U.S. Pat. No. 4,486,915 to Stewart et al. discloses a flocked hair brush.

U.S. Pat. No. 4,469,934 to Isshiki et al. discloses an electrically heated hair curling brush with selectively rotatable handle.

U.S. Pat. No. 4,377,013 to Tuller discloses a rotatable hair brush.

U.S. Pat. No. 3,909,868 to Nogues discloses a cylindrical hair brush.

U.S. Pat. No. 3,843,990 to Lardenois discloses a cylindrical hair brush.

While these devices fulfill their respective, particular objective and requirements, the aforementioned patents do not describe a rotating hair brush for rotating a hair brush so as not to pull on hair while brushing.

In this respect, the rotating hair brush according to the present invention substantially departs from the conventional concepts and designs of the prior art, and in doing so provides an apparatus primarily developed for the purpose of rotating a hair brush so as not to pull on hair while brushing.

Therefore, it can be appreciated that there exists a continuing need for new and improved rotating hair brush which can be used for rotating a hair brush so as not to pull on hair while brushing. In this regard, the present invention substantially fulfills this need.

SUMMARY OF THE INVENTION

In the view of the foregoing disadvantages inherent in the known types of cylindrical hair brushes now present in the prior art, the present invention provides an improved rotating hair brush. As such, the general purpose of the present invention, which will be described subsequently in greater detail, is to provide a new and improved rotating hair brush and method which has all the advantages of the prior art and none of the disadvantages.

To attain this, the present invention essentially comprises a handle portion having a first end and a second end. The first end has a first cylindrical chamber extending inwardly therefrom. The second end has a second cylindrical chamber extending inwardly therefrom in alignment with the first cylindrical chamber. The second cylindrical chamber has a detent projection formed on an end portion thereof and a slot formed in an opposing side therefrom. The device includes a rotating brush portion having a plurality of bristles extending radially therearound. The rotating brush portion has a shaft portion dimensioned to be rotatably received within the first cylindrical chamber of the handle portion. The shaft portion has a pair of bushings coupled around end portions thereof. The shaft portion has a T-shaped projecting portion extending therefrom into the second cylindrical chamber. The shaft portion has a washer and snap ring secured therearound inwardly of the T-shaped projecting portion. The device includes a rotation lock portion having a grasping portion and a shaft portion. The shaft portion is dimensioned to be received within the second cylindrical chamber of the handle portion. The shaft portion has a first detent and a second detent formed therein. The first detent and the second detent selectively cooperate with the detent projection of the handle portion. The shaft portion has a T-shaped indentation formed in an end portion thereof dimensioned for selective cooperation with the T-shaped projecting portion of the rotating brush portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rotating hair brush which has all the advantages of the prior art cylindrical hair brushes and none of the disadvantages.

It is another object of the present invention to provide a new and improved rotating hair brush which may be easily and efficiently manufactured and marketed.

It is a further object of the present invention to provide a new and improved rotating hair brush which is of durable and reliable construction.

An even further object of the present invention is to provide a new and improved rotating hair brush which is susceptible of a low cost of manufacture with regard to both materials and labor, and which accordingly is then susceptible of low prices of sale to the consuming public, thereby making such a rotating hair brush economically available to the buying public.

Still yet another object of the present invention is to provide a new and improved rotating hair brush which provides in the apparatuses and methods of the prior art some of the advantages thereof, while simultaneously overcoming some of the disadvantages normally associated therewith.

Even still another object of the present invention is to provide a new and improved rotating hair brush for rotating a hair brush so as not to pull on hair while brushing.

Lastly, it is an object of the present invention to provide a new and improved rotating hair brush comprised of a handle portion having a detent projection formed on an end portion thereof and a slot formed in an opposing side therefrom. A rotating brush portion has a plurality of bristles extending radially therearound. The rotating brush portion has a shaft portion dimensioned to be rotatably received within the handle portion. A rotation lock portion has a shaft portion dimensioned to be received within the handle portion. The shaft portion has a first detent and a second detent formed therein. The first detent and the second detent selectively cooperate with the detent projection of the handle portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
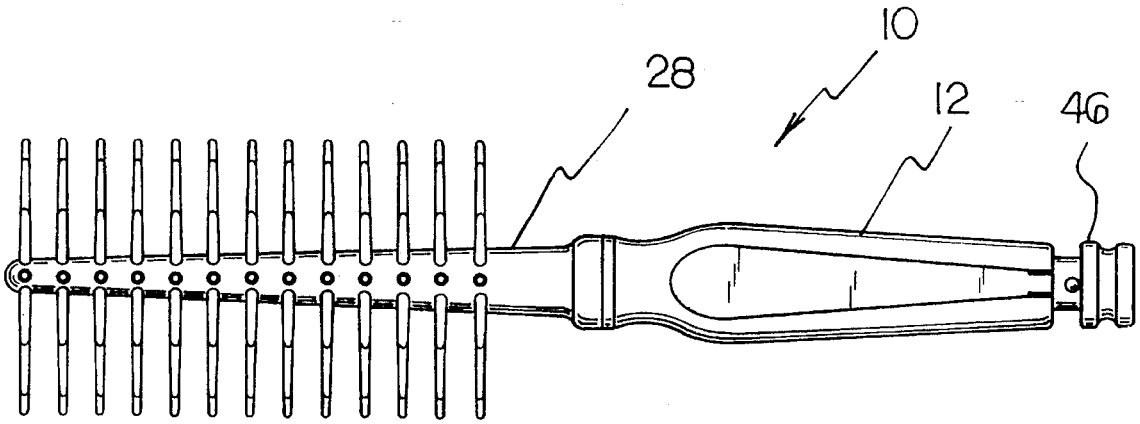
FIG. 1 is a side view of the preferred embodiment of the rotating hair brush constructed in accordance with the principles of the present invention.
Figure 2:
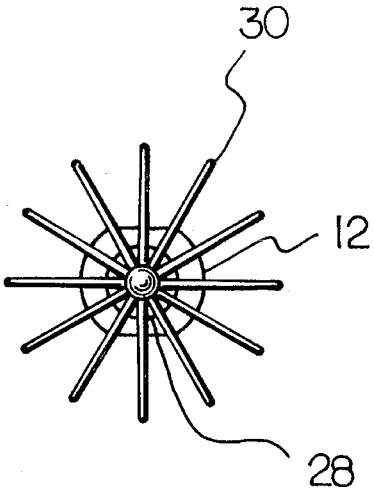
FIG. 2 is a front elevation view of the present invention.
Figure 3:
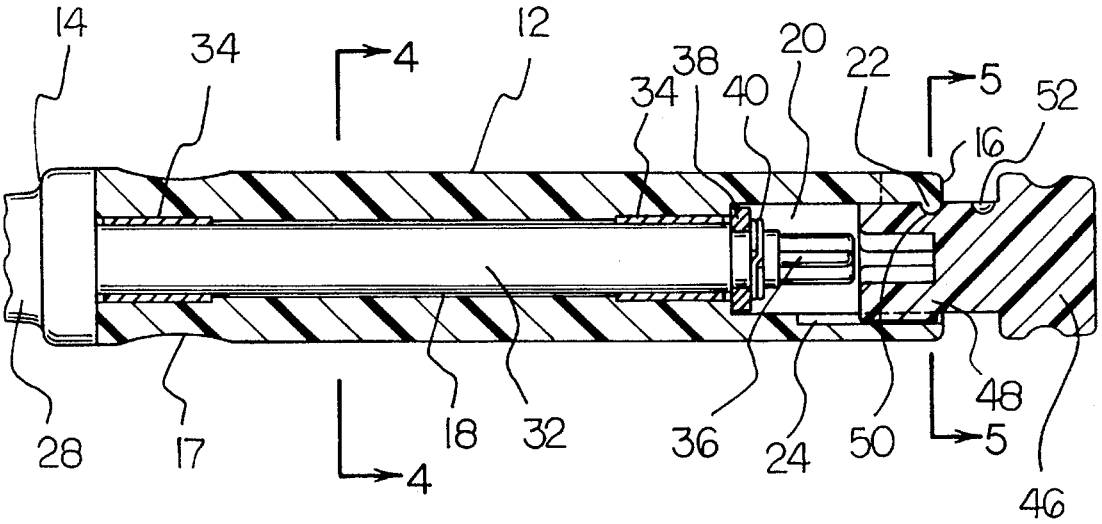
FIG. 3 is a cross-sectional view of the handle of the present invention.
Figure 4:
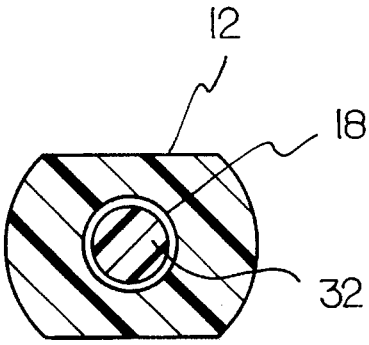
FIG. 4 is a cross-sectional view as taken along line 4—4 of FIG. 3.
Figure 5:
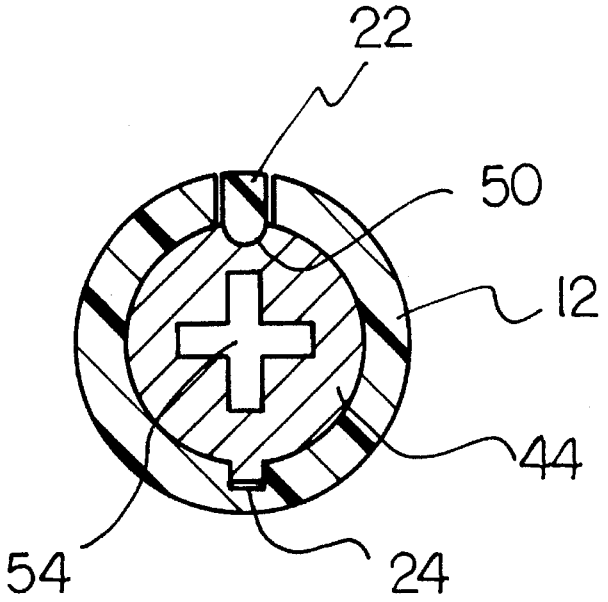
FIG. 5 is a cross-sectional view as taken along line 5—5 of FIG. 3.
Figure 6:
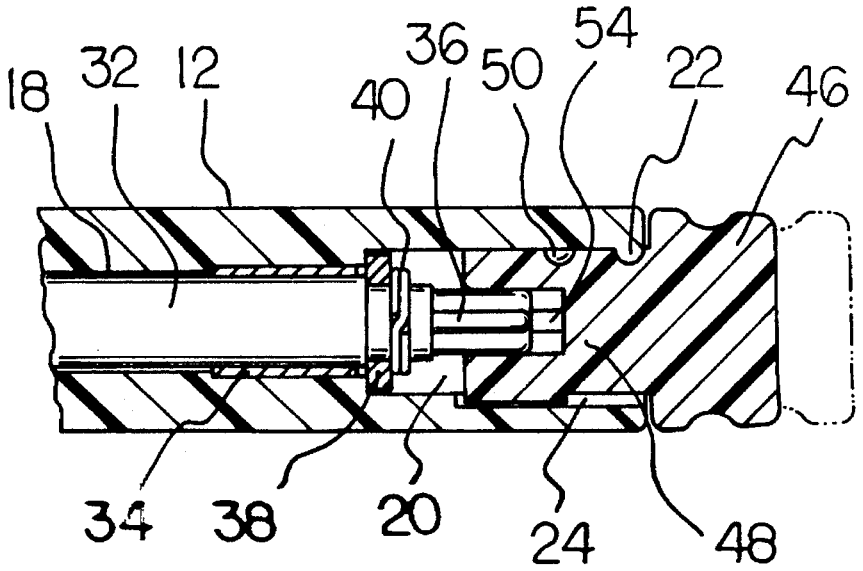
FIG. 6 is a cross-sectional view of the handle in the locked position.

With reference now to the drawings, and in particular, to FIGS. 1–6 thereof, the preferred embodiment of the new and improved rotating hair brush embodying the principles and concepts of the present invention and generally designated by the reference number 10 will be described.

Specifically, it will be noted in the various Figures that the device relates to a new and improved rotating hair brush for rotating a hair brush so as not to pull on hair while brushing. In its broadest context, the device consists of a handle portion, a rotating brush portion, and a rotation lock portion. Such components are individually configured and correlated with respect to each other so as to attain the desired objective.

Included in the device 10 is a handle portion 12 having a first end 14 and a second end 16. The first end having indentations 17 formed on opposing sides thereof that allow for a user to comfortably hold the device 10. The first end 14 has a first cylindrical chamber 18 extending inwardly therefrom. The second end 16 has a second cylindrical chamber 20 extending inwardly therefrom in alignment with the first cylindrical chamber 18. The second cylindrical chamber 20 has a diameter greater than the diameter of the first cylindrical chamber 18. The first cylindrical chamber 18 has a length greater than two times the length of the second cylindrical chamber 20. The second cylindrical chamber 20 has a detent projection 22 formed on an end portion thereof and a slot 24 formed in an opposing side therefrom.

Next, the device 10 includes a rotating brush portion 28 having a plurality of bristles 30 extending radially therearound. The rotating brush portion 28 has a shaft portion 32 dimensioned to be rotatably received within the first cylindrical chamber 18 of the handle portion 12. The shaft portion 32 has a length equal to that of the first cylindrical chamber 18 and a diameter slightly less than the diameter of the first cylindrical chamber 18 to allow for the shaft portion 32 to rotate relative the handle portion 12. The shaft portion 32 has a pair of bushings 34 coupled around end portions thereof. The bushings 34 allow the shaft portion 32 to rotate freely within the first cylindrical chamber 18. The shaft portion 32 has a T-shaped projecting portion 36 extending therefrom into the second cylindrical chamber 20. The shaft portion 32 has a washer 38 and snap ring 40 secured therearound inwardly of the T-shaped projecting portion 36. The washer 38 and snap ring 40 serve to prevent the shaft portion 32 from becoming disengaged from the handle portion 12.

Lastly, the device 10 includes a rotation lock portion 44 having a grasping portion 46 and a shaft portion 48. The shaft portion 48 is dimensioned to be received within the second cylindrical chamber 20 of the handle portion 12. The shaft portion 48 has a first detent 50 and a second detent 52 formed therein. The first detent 50 and the second detent 52 selectively cooperate with the detent projection 22 of the handle portion 12. When the first detent 50 is engaged with the detent projection 22, the rotating brush portion 28 is permitted to freely rotate within the handle portion 12. The shaft portion 48 has a T-shaped indentation 54 formed in an end portion thereof dimensioned for selective cooperation with the T-shaped projecting portion 36 of the rotating brush portion 28. When the second detent 52 is engaged with the detent projection 22, the T-shaped indentation 54 receives the T-shaped projecting portion 36 therein to prevent the rotating brush portion 28 from rotating within the handle portion 12. A user can simply pull outwardly on the grasping portion 46 to disengage the detent projection 22 from the second detent 52 to allow the rotating brush portion 28 to rotate.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A rotating hair brush for rotating a hair brush so as not to pull on hair while brushing comprising, in combination:

a handle portion having a first end and a second end, the first end having a first cylindrical chamber extending inwardly therefrom, the second end having a second cylindrical chamber extending inwardly therefrom in alignment with the first cylindrical chamber, the second cylindrical chamber having a detent projection formed on an end portion thereof and a slot formed in an opposing side therefrom;

a rotating brush portion having a plurality of bristles extending radially therearound, the rotating brush portion having a shaft portion dimensioned to be rotatably received within the first cylindrical chamber of the handle portion, the shaft portion having a pair of bushings coupled around end portions thereof, the shaft portion having a T-shaped projecting portion extending therefrom into the second cylindrical chamber, the shaft portion having a washer and snap ring secured therearound inwardly of the T-shaped projecting portion;

a rotation lock portion having a grasping portion and a shaft portion, the shaft portion dimensioned to be received within the second cylindrical chamber of the handle portion, the shaft portion having a first detent and a second detent formed therein, the first detent and the second detent selectively cooperating with the detent projection of the handle portion, the shaft portion having a T-shaped indentation formed in an end portion thereof dimensioned for selective cooperation with the T-shaped projecting portion of the rotating brush portion.

2. A rotating hair brush comprising, in combination:

a handle portion having a detent projection formed on an end portion thereof and a slot formed in an opposing side therefrom;

a rotating brush portion having a plurality of bristles extending radially therearound, the rotating brush portion having a shaft portion dimensioned to be rotatably received within the handle portion;

a rotation lock portion having a shaft portion dimensioned to be received within the handle portion, the shaft portion having a first detent and a second detent formed therein, the first detent and the second detent selectively cooperating with the detent projection of the handle portion.

3. The rotating hair brush as set forth in claim 2 wherein the handle portion having a first end and a second end, the first end having a first cylindrical chamber extending inwardly therefrom, the second end having a second cylindrical chamber extending inwardly therefrom in alignment with the first cylindrical chamber.

4. The rotating hair brush as set forth in claim 2 wherein the shaft portion of the rotating brush portion having a pair of bushings coupled around end portions thereof.

5. The rotating hair brush as set forth in claim 2 wherein the shaft portion of the rotating portion having a T-shaped projecting portion extending therefrom, and the shaft portion of the rotation lock portion having a T-shaped indentation formed in an end portion thereof dimensioned for selective cooperation with the T-shaped projecting portion of the rotating brush portion.

* * * * *